US011491523B2

(12) United States Patent
Feldmann et al.

(10) Patent No.: US 11,491,523 B2
(45) Date of Patent: Nov. 8, 2022

(54) HYDRAULIC CONTROL OF A ROLL GAP FOR A ROLL STAND

(71) Applicant: Muhr und Bender KG, Attendorn (DE)

(72) Inventors: Andre Feldmann, Olpe (DE); Harald Eichner, Hennef (DE); Alexander Eick, Plettenberg (DE)

(73) Assignee: Muhr und Bender KG, Attendorn (DE)

( * ) Notice: Subject to any disclaimer, the term of this patent is extended or adjusted under 35 U.S.C. 154(b) by 0 days.

(21) Appl. No.: 17/053,388

(22) PCT Filed: May 7, 2019

(86) PCT No.: PCT/EP2019/061747
§ 371 (c)(1),
(2) Date: Nov. 6, 2020

(87) PCT Pub. No.: WO2019/215197
PCT Pub. Date: Nov. 14, 2019

(65) Prior Publication Data

US 2021/0229151 A1 Jul. 29, 2021

(30) Foreign Application Priority Data

May 11, 2018 (EP) ..... 18171953

(51) Int. Cl.
*B21B 37/62* (2006.01)
*B21B 37/26* (2006.01)
(Continued)

(52) U.S. Cl.
CPC ..... *B21B 37/62* (2013.01)

(58) Field of Classification Search
CPC ..... B21B 37/62; B21B 37/26; B21B 38/02; B21B 38/04; B21B 31/32
See application file for complete search history.

(56) References Cited

U.S. PATENT DOCUMENTS 3,693,385 A * 9/1972 Fujino ..... B21B 37/62 72/10.6
3,736,782 A * 6/1973 Fujino ..... B21B 31/32 72/10.7
(Continued)

FOREIGN PATENT DOCUMENTS

DE 3803490 C2 5/1992
DE 10254958 A1 * 6/2004 ..... B21B 37/58
(Continued)

OTHER PUBLICATIONS

English translate (JPH0552202A), retrieved date Jan. 3, 2022.*
(Continued)

*Primary Examiner* — Adam J Eiseman
*Assistant Examiner* — Mohammed S. Alawadi
(74) *Attorney, Agent, or Firm* — Bejin Bieneman PLC

(57) ABSTRACT

A roll stand with at least one working roll for rolling strip material and with a hydraulic arrangement for controlling a roll gap of the roll stand, comprises at least one hydraulic adjustment unit for adjusting the roll gap, the hydraulic adjustment unit comprising a cylinder and an adjusting piston dividing the cylinder into a first chamber and a second chamber; a first double-acting valve arrangement and a second double-acting valve arrangement which are each connected to the first chamber and the second chamber for variable control of the adjusting unit, wherein the second double-acting valve arrangement is connected in parallel with the first valve arrangement and has a larger nominal volume flow than the latter; and wherein the adjusting unit can be pressurized with an working pressure of more than 200 bar.

15 Claims, 5 Drawing Sheets

(51) Int. Cl.

| | |
|---|---|
| ***B21B 38/02*** | (2006.01) |
| ***B21B 38/04*** | (2006.01) |
| ***B21B 31/32*** | (2006.01) |

(56) References Cited

U.S. PATENT DOCUMENTS

| | | | | | |
|---|---|---|---|---|---|
| 3,864,951 | A | * | 2/1975 | Gulyaev | B21B 31/32 72/12.5 |
| 3,974,672 | A | * | 8/1976 | Herbst | B21B 37/62 72/31.07 |
| 4,481,801 | A | * | 11/1984 | deVersterre | B21B 31/028 72/14.5 |
| 5,297,408 | A | * | 3/1994 | Yoshida | B21B 37/62 72/12.7 |

FOREIGN PATENT DOCUMENTS

| | | | | | |
|---|---|---|---|---|---|
| DE | 10254958 | A1 | | 6/2004 | |
| EP | 1459813 | A2 | * | 9/2004 | B21B 31/32 |
| EP | 1459813 | A2 | | 9/2004 | |
| JP | S5114593 | A | | 2/1976 | |
| JP | H0552202 | A | * | 3/1993 | |
| JP | H0552202 | A | | 3/1993 | |
| JP | H0911000 | A | * | 1/1997 | |
| JP | H0911000 | A | | 1/1997 | |
| JP | 2001311401 | A | * | 11/2001 | |
| JP | 2001311401 | A | | 11/2001 | |
| JP | 2004251331 | A | | 9/2004 | |
| WO | 2007093333 | A1 | | 8/2007 | |

OTHER PUBLICATIONS

English translate (JP2001311401A), retrieved date Jan. 3, 2022.*
English translate (JPH0911000A), retrieved date Jan. 3, 2022.*
English translate (DE10254958A1), retrieved date Jan. 3, 2022.*
English translate (EP1459813A2), retrieved date Jan. 3, 2022.*
International Search Report and Written Opinion for PCT/EP2019/061747 dated Aug. 9, 2019 (12 pages; with English translation).

* cited by examiner

ΔX
1
2
3
4
9
10
11
12
13
14
15
16
17
20
21
A
B
P
T

HYDRAULIC CONTROL OF A ROLL GAP FOR A ROLL STAND

CROSS-REFERENCE TO RELATED APPLICATIONS

This application is a national stage of, and claims priority to, Patent Cooperation Treaty Application No. PCT/EP2019/061747, filed on May 7, 2019, which application claims priority to European Application No. 18171953.5, filed on May 11, 2018, which applications are hereby incorporated herein by reference in their entireties.

BACKGROUND

In strip rolling mills, strip material with an entry thickness is rolled in a hot or cold state in one or more steps to a nominal thickness. The strip material is guided through a defined roll gap, which is formed by two working rolls. The roll gap can be adjusted by a hydraulic adjusting unit, which is usually used to compensate for disturbances in the rolling process, such as changes in the initial thickness. In standard flat rolling processes strip material is produced with a constant nominal thickness, so that after an initial adjustment of the nominal roll gap only small deviations resulting from the influence of disturbance variables need to be readjusted. Flexible rolling produces strip material with a variable nominal thickness profile in the longitudinal direction of the strip. In addition to the correction of deviations caused by disturbance variables, the roll gap must be adjusted to the nominal thickness profile. The roll gap changes required for this are usually many times greater than the roll gap changes caused by the correction of the disturbance variables. In order to achieve high rolling speeds and thus high productivity in flexible rolling, a device for controlling the roll gap must allow relatively long strokes of the rolls in a short time with simultaneous high-precision adjustment of the roll gap.

From JP-H05-52202 a hydraulic arrangement for controlling the rolling force of a roll stand is disclosed. The hydraulic arrangement features a single-acting piston-cylinder-unit and several servo valves. A high flow servo valve and a low flow servo valve are both connected to the pressure chamber of the piston-cylinder-unit. A pressure reducing valve can be connected to the second chamber. In normal operation, position control is only performed by the low flow servo valve. The high flow servo valve is only used when it is necessary to make a large change in position in an extremely short time, such as fast opening and closing of the rolls for removal of the rolls when an irregularity occurs.

A hydraulic control device is known from JP 2001311401. Several servo valves are connected in parallel with a hydraulic actuator in the form of a piston-cylinder-unit. The servo valves can have the same or different flow rates. Several of the servo valves can be operated simultaneously.

From JP 2004251331 A a hydraulic cylinder with a piston-side cylinder chamber and a head-side cylinder chamber is known. A pressure line is connected to the head-side cylinder chamber, from which a return line to the tank branches off. A first group of parallel arranged on-off solenoid control valves is provided in the pressure line. A second group of parallel on-off solenoid control valves is provided in the return line branched off from the pressure line. The line to the piston-side cylinder chamber is valveless.

From JP-S51-14593 a hydraulic device of a working machine of a construction site vehicle is known. The hydraulic device comprises a double-acting hydraulic cylinder and two switching valves, each of which is connected to both cylinder chambers of the hydraulic cylinder. Depending on the switching position of the switching valves, the hydraulic cylinder can be extended quickly or slowly.

From EP 1 459 813 A2, an adjusting cylinder for roll stands for rolling steel or non-ferrous metal is known. The adjusting cylinder comprises a cylinder housing in which an adjusting piston and a counter piston are arranged. A first pressure chamber is formed between the cylinder wall and the set piston, a second pressure chamber is formed between the set piston and the counter piston, and a third pressure chamber is formed between the counter piston and the opposite cylinder wall. A pressure line for hydraulic fluid is assigned to each pressure chamber. The pressure that can be applied to the first two pressure chambers can range from 10 bar to 250 bar. The pressure that can be applied to the third pressure chamber is below 5 bar.

From DE 38 03 490 C2 a device for hydraulic control of a printing roll by means of adjusting cylinders is known. To control pressure medium paths between the two chambers of an actuator cylinder, a pressure medium source and a tank, the device includes a switchable valve. The disadvantage of this design of the hydraulic control is that one valve can either be designed in such a way that it moves the actuating cylinder as quickly or as precisely as possible.

SUMMARY

The present disclosure relates to a roll stand with a hydraulic arrangement and a method for controlling a roll gap of the roll stand, in particular for the flexible rolling of strip material. The hydraulic arrangement, and method for controlling a roll gap of a roll stand or a roll stand with such a hydraulic arrangement, provides for a variable, highly dynamic adjustment of the roll gap with high positional accuracy and rolling at high rolling speeds.

A hydraulic arrangement for controlling a roll gap of a roll stand comprises at least one hydraulic adjusting unit for adjusting the roll gap; a first double-acting valve arrangement for variably controlling the adjusting unit; and a second double-acting valve arrangement for variably controlling the adjusting unit, which is connected in parallel with the first valve arrangement and has a larger nominal volume flow than the first valve arrangement. The roll stand comprises at least two working rolls that define the roll gap. By moving at least one of the working rolls and/or changing the roll gap during rolling, the strip material can be rolled flexibly so that it has a variable thickness along its length. The hydraulic adjusting unit is operatively connected to at least one of the working rolls in order to move it. The operational connection can be made indirectly via one or more further components, in particular via at least one chock and/or, as the case may be, via at least one supporting roll. In more concrete terms, the adjusting unit can have a cylinder and an adjusting piston, wherein the adjusting piston is movable in the cylinder and divides it into a first chamber and a second chamber. The first and the second valve arrangement are each double-acting, for which purpose they are hydraulically connected to the first and the second chamber of the adjusting unit. This allows each of the valve arrangements to apply hydraulic pressure to both chambers of the adjusting unit to actuate the adjusting unit in both directions, i.e. opening and closing. The hydraulic adjusting unit may be designed to be pressurized by one or more pressure medium sources with a working pressure of more than 200 bar in particular. The working pressure can be transmitted to the first and/or second chamber via the two valve arrangements in order to pressurize the piston accordingly.

The hydraulic arrangement and/or the roll stand according to the disclosure has the advantage that, at least for a partial number of roll gap changes during rolling, a defined stroke between a start or actual roll position and a nominal roll position can be divided into several sections, wherein in a first section a major part of the stroke can be realized by means of the second valve arrangement with a large nominal volume flow and high actuating speeds and in a second section a highly precise positioning of the rolls can be realized by the first valve arrangement with a smaller nominal volume flow and lower actuating speeds. The arrangement is particularly suitable for flexible rolling of strip material, in which strip material with a variable thickness over the length is produced, as this allows highly dynamic and fast control of the roll gap with high accuracy.

Nominal volume flow should be understood as the maximum volume flow of the incoming or outgoing hydraulic fluid when fully opened by the respective valve arrangement, which results at a specific pressure difference. According to a possible embodiment, the second valve arrangement may have a nominal volume flow which is at least twice, in particular at least 8 times, in particular at least 10 times, in particular at least 15 times, the nominal volume flow of the first valve arrangement. Where one of the first and/or second valve arrangements includes several individual valves, the nominal volume flow rate indicated for the respective arrangement shall refer to the sum of the respective nominal volume flows of the individual valves of this first respectively second valve arrangement.

Within the scope of this disclosure, the hydraulic adjusting unit shall include any unit capable of converting hydraulic energy transferable from the first and/or second valve arrangement into mechanical energy. At least one hydraulic adjusting unit is provided for controlling the roll gap in a roll stand, which includes the possibility of two or more adjusting units. In particular, an associated adjusting unit may be provided on each side of a working roll of a roll stand. In this case the two adjusting units can be controlled synchronously to move the working roll.

In a possible embodiment, the at least one hydraulic adjusting unit may comprise a cylinder and an adjusting piston, wherein the adjusting piston movably divides the cylinder into a first chamber and a second chamber. In this case, the adjusting unit is a double-acting cylinder and can also be called a piston-cylinder-unit. By pressurizing the first chamber with a working pressure and supplying a volume flow from a pressure medium source, the adjusting piston is moved towards the second chamber and vice versa. In particular, the adjusting unit comprises exactly one, i.e. not more than one piston, which divides the cylinder accordingly into exactly two chambers, i.e. not more than two chambers. The adjusting piston is operatively connected to the working roll in such a way that moving the piston causes the working roll to move relative to the strip material and thus changes the roll gap. The adjusting piston can act directly or indirectly on the working roll via further components, in particular one or more supporting rolls. For example, the adjusting piston can move a chock, which is vertically displaceably arranged in a roll stand and in which a first working roll or a supporting roll acting on the first working roll is rotatably mounted, or can apply a rolling force to this chock. The first working roll can be mounted in the roll stand in a displaceable manner, in particular by means of two chocks, i.e. one chock on each side. The first working roll can form a roll gap together with a second working roll, which is rotatably mounted and arranged in the roll stand so as to be secured against displacement. The roll gap can thus be variably adjusted by the adjusting unit and a defined rolling force can be applied to a strip material.

The required volume flow into one chamber of the adjusting unit and out of the opposite chamber is determined by the stroke of the adjusting piston and the cross-sectional area acting in the first and second chamber, respectively. The cross-sectional areas of the first chamber and the second chamber may differ. In particular, due to a piston rod, one of the chambers may have an ring-shaped cross-section with an outside diameter, while the other chamber has a circular cross-section with the same outside diameter.

In one possible embodiment, the hydraulic adjusting unit can be pressurized by one or more pressure medium sources with a working pressure greater than 200 bar, in particular greater than 230 bar, in particular greater than 250 bar, in particular greater than 270 bar, in particular greater than 270 bar, and possibly also greater than 300 bar. The high pressures ensure that high piston speeds are achieved at the adjusting units, with fast switching times of less than 200 ms (milliseconds). In addition, the high pressures allow sufficient rolling force to be applied to the working rolls. All in all, a highly dynamic roll gap control is thus achieved. With an increasing number of pressure medium sources, a faster supply of the required volume of hydraulic fluid can be ensured. In principle, however, any arrangement is conceivable that can provide a substantially constant working pressure. In a possible embodiment, one of the one or more pressure medium sources may have a pump or a pressure medium reservoir with a connected pump. The first and second valve arrangements may be supplied from a common pressure medium source or a subset of the pressure ports of the first and second valve arrangements may be connected to a separate pressure medium source.

Double-acting valve arrangements are to be understood as all valve arrangements through which volume flows can be variably adjusted in such a way that a double-acting cylinder can be both extended and retracted. The use of two valve arrangements with different volume flows allows the double-acting cylinder to be moved both quickly and slowly. For this purpose, the adjusting unit of the hydraulic arrangement according to the disclosure can be extended and retracted by both the first valve arrangement and the second valve arrangement independently of each other and/or in combination of both valve arrangements.

In a possible embodiment, the first valve arrangement can control a volume flow of a first pressure medium path connected to the first chamber and a volume flow of a second pressure medium path connected to the second chamber. The second valve arrangement can control a volume flow of a third pressure medium path connected to the first chamber and a volume flow of a fourth pressure medium path connected to the second chamber. The first and second valve arrangements can be used to control a volume flow out of one of the chambers of the adjusting cylinder and into one of the chambers of the adjusting cylinder, respectively. The volume flows controlled by the first and second valve arrangements can be set in a fully variable manner at a defined working pressure from an open position to a closed position. For this purpose, in a possible embodiment, one valve of the first valve arrangement and one valve of the second valve arrangement may each be designed as a continuous valve, in particular as a servo valve. Pilot operated valves can also be used.

In a possible embodiment, the second valve arrangement may include at least one valve to control the hydraulic adjusting unit. A valve has a control element, for example a valve piston, by which the volume flow through the valve can be controlled. In embodiments with a single valve, the valve arrangement can be controlled with low control complexity. In embodiments with several valves, several kinematically decoupled valve control elements can be controlled and thus a highly variable actuation of the adjusting unit can be realized. In a further embodiment, the first valve arrangement may include at least one valve for controlling the hydraulic adjusting unit. The above mentioned advantages apply analogously.

The first and the second valve arrangement may each comprise any number of valves connected in series and/or in parallel, which together permit double-acting control of the adjusting unit, the resulting nominal volume flow of the second valve arrangement being in particular many times greater than the resulting nominal volume flow of the first valve arrangement. Where the first and/or second valve arrangement includes several individual valves, these individual valves may each be designed to be single-acting or double-acting, i.e. to act hydraulically on the adjusting unit in only one actuation direction or in both actuation directions. For example, a first valve of the respective valve arrangement can act on the adjusting unit in such a way that it is retracted, while a second valve of the valve arrangement acts on the adjusting unit in such a way that it is extended, in particular according to the so-called principle of split control edges. Together, the first and second valve thus form a double-acting valve arrangement, which is hydraulically connected to the first and second chamber of the adjusting unit. Alternatively or in addition, one or both of the valve arrangements may also include one or more valves, each of which is designed to be double-acting, i.e. where the respective valve can act on the adjusting unit in both directions. It is understood that the above possibilities apply to the first and/or second valve arrangement. The nominal volume flow of valve arrangements with several valves should be the maximum total volume flow flowing in or out through the valves of a valve arrangement at a certain pressure difference. In particular, the valve arrangements can be composed of 2/2, 3/2, 3/3, 4/2, 4/3, or 5/3-way valves. For example, a valve arrangement can be formed from a parallel connection of two 3/3-way valves or two 4/3-way valves.

The first valve arrangement and the second valve arrangement are hydraulically connected to a main tank. One or more pressure storages can optionally be provided in the supply line (pressure line) between the main tank and the first or second valve arrangement. The at least one pressure storage serves in particular to ensure a continuous flow of pressure oil to the first and/or second valve arrangement and to compensate for consumption peaks.

To drain off and store hydraulic fluid flowing out of the adjusting unit, in a possible embodiment, an intermediate tank may be arranged in a return line between the first valve arrangement and a main tank and/or between the second valve arrangement and the main tank. From the intermediate tank, the hydraulic fluid is then pumped into the main tank. The intermediate tank allows the hydraulic fluid column to be relaxed at an early stage and pulsations in the return line between the valve and the main tank can be reduced, so that the hydraulic fluid flowing out of the adjusting unit can be discharged more quickly. To dampen the pulsations of the hydraulic fluid, pulsation dampers in the return line between the valve arrangements and the main tank, especially before the intermediate tank, are also conceivable. In a possible embodiment, the intermediate tank can be located above the main tank. In this respect, the intermediate tank can also be called a high tank. In particular, the intermediate tank may be located at a vertical height with the first and second valve arrangements and/or at a distance less than three meters, in particular less than two meters, from the valve arrangements.

A method for controlling a roll gap of a roll stand, in particular by means of one of the hydraulic arrangements described above or roll stand with such a hydraulic arrangement, includes the steps: determining an actual roll position of a working roll; determining a nominal roll position of the working roll; and controlling an opening degree of the first valve arrangement and an opening degree of the second valve arrangement for controlling the adjusting unit depending on the actual roll position and the nominal roll position, wherein the roll gap is changed during rolling, and wherein for at least one thickness change of a thickness profile to be rolled, the adjusting unit is controlled during rolling in a first section of a stroke between the actual roll position and the nominal roll position by the first valve arrangement and the second valve arrangement, and in a second section of the stroke only by the first valve arrangement. In this context, the first respectively the second section of the stroke can be any section of stroke between the actual and the nominal position. Further stroke sections are conceivable, which can be upstream, intermediate and/or downstream. Thus, various control possibilities are conceivable with the first and second valve arrangement, for example opening at least one valve of the first valve arrangement, subsequently opening at least one valve of the second valve arrangement, closing the valve of the second valve arrangement again and then closing the valve of the first valve arrangement again. The opening of at least one valve of the first valve arrangement and at least one valve of the second valve arrangement can also take place simultaneously or in reverse order.

The described controlling refers to at least one thickness change during the rolling process for the production of a particularly flexible rolled strip material. This means that during the rolling of the strip material, at least for a partial number of roll gap changes or strokes, hydraulic control of the adjusting unit(s) takes place by means of the first and second valve arrangement. This allows the desired roll gap to be set quickly, whereby precise positioning can then be achieved by means of the valve arrangement designed for the smaller nominal volume flow. It is understood that during the rolling process, thickness changes of profile sections to be produced can also be carried out by means of only one of the two valve arrangements, in particular the small valve arrangement for smaller strokes.

In particular, it is provided that the controlling of the adjusting unit in the first section of a stroke between the actual roll position and the nominal roll position is effected by means of the first and/or second valve arrangement for achieving high actuating speeds, and in the second section of the stroke, which in particular comprises the nominal roll position, is effected by the two valve arrangements solely by means of the first valve arrangement for achieving high positional accuracy. According to a possible embodiment, the adjusting unit can be controlled for roll gap changes of more than 10% deviation between actual and nominal position, in particular of more than 5% of the roll gap dimension, by means of the first and second valve arrangement in the first section of the stroke ($\Delta X$). An absolute value at which both valve arrangements are controlled to actuate the adjusting unit can be specified, for example, with a thickness or roll gap change greater than 0.1 mm (millimeters).

The method has advantages analogous to those of the hydraulic arrangement according to the disclosure. It is understood, therefore, that all the features mentioned in connection with the arrangement can be transferred analogously to the method and, vice versa, all the features mentioned in connection with the method are transferable to the arrangement.

In a possible embodiment of the method, at least one setting variable for controlling the opening degree of the first valve arrangement and at least one setting variable for controlling the opening degree of the second valve arrangement can be output with a time offset. In a further possible embodiment, a first setting variable for a first valve of the first valve arrangement and a second setting variable for a second valve of the first valve arrangement can be output with a time delay for controlling the opening degree of the first valve arrangement and/or a first setting variable for a first valve of the second valve arrangement and a second setting variable for a second valve of the second valve arrangement can be output with a time offset for controlling the opening degree of the second valve arrangement. Both of the above-mentioned embodiments allow for increased variability in the control of the adjusting unit. However, it is understood that the first valve arrangement and the second valve arrangement, and/or individual valves of the first and/or second valve arrangement, can also be operated simultaneously.

In a further embodiment, the nominal roll position can be determined depending on a nominal thickness profile and at least one of a thickness measurement on the entry side of the working roll and a profile thickness measurement on the exit side of the working roll.

BRIEF SUMMARY OF THE DRAWINGS

In the following figure representations, example embodiments the disclosed hydraulic arrangement and method are described. Thereby FIG. 1 schematically shows a hydraulic arrangement and a roll stand with a hydraulic arrangement according to a first embodiment.

DESCRIPTION

Figure 1:
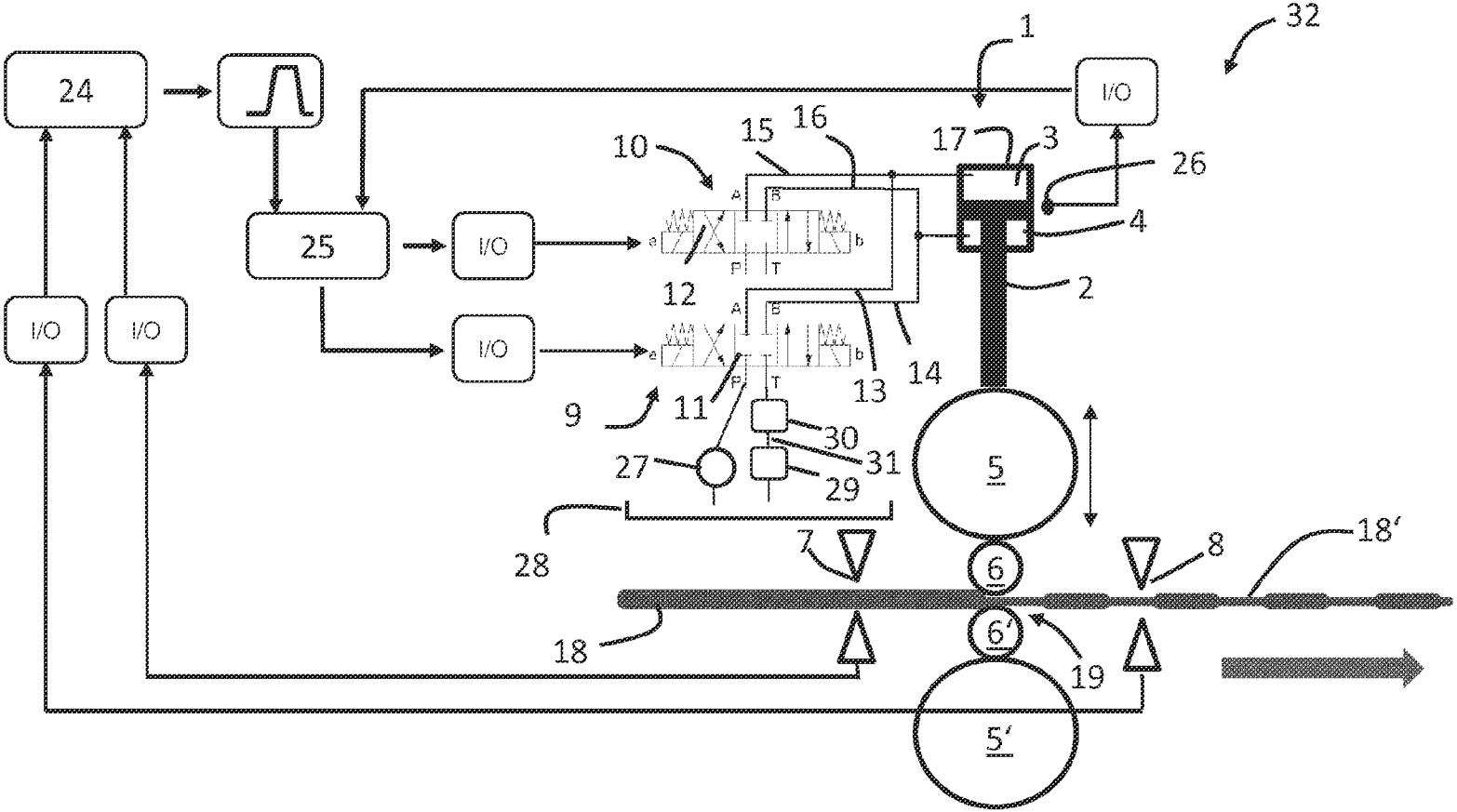

FIGS. 1 and 2*a* to 2*d*, which are described together in the following, schematically show a roll stand 32 and a hydraulic arrangement for controlling a roll gap 19 of the roll stand according to a first embodiment. In the rolling process, incoming strip material 18 is rolled through the roll gap 19 from a constant nominal thickness to a variable thickness profile of the outgoing strip material 18'. The roll gap 19 is formed by two working rolls 6, 6' of roll stand 32, which is designed as a four-high roll stand. A four-high roll stand, as the name suggests, comprises four rolls, two working rolls 6, 6' and two supporting rolls 5, 5', although it is understood that rolling stands with a different number of rolls can also be used, for example two-high or three-high roll stands.

The working rolls 6, 6' are each supported by a supporting roll 5, 5' to reduce the deflection of the working rolls 6, 6'. The working rolls 6, 6' and the supporting rolls 5, 5' are each rotatably mounted in chocks not shown in the figures. The chocks are in turn accommodated in a roll column of roll stand 32. It is provided that the rolls 5, 6; 5', 6' are each rotatably mounted at their ends in an associated chock, i.e. two chocks are provided per roll, which together support the roll rotatably. In the present embodiment, the chocks of the lower working roll 6' and the lower supporting roll 5' are firmly held in the roll column, and the chocks of the upper working roll 6 and the upper supporting roll 5 are mounted or guided in the roll stand 32 so as to be vertically displaceable. To change the roll gap 19, only the upper supporting roll 5 and the upper working roll 6 are moved vertically, while the lower supporting roll 5' and lower working roll 6' are kept stationary. However, arrangements are also possible in which only the lower rolls 5', 6' are moved and the upper rolls 5, 6 are kept stationary, or in which both the upper rolls 5, 6 and the lower rolls 5', 6' are vertically movable against each other.

At least one adjusting unit 1, which acts at least indirectly on a working roll, is provided for adjusting or changing the roll gap 19. For each chock of an adjustable roll, an associated adjusting unit 1 can be provided, i.e. the adjustable roll is set via two adjusting units. The adjustable roll can be a working roll, for example in a two-high roll stand, i.e. in this case the adjusting unit 1 acts on the chocks of the working roll. The adjustable roll can also be a supporting roll, for example in a four-high roll stand, in which case the adjusting unit 1 acts on the chocks of the supporting roll 5, which in turn adjusts the working roll 6.

In the present embodiment, it is provided in particular that the chocks of the upper supporting roll 5 are each positioned vertically by means of one adjusting unit 1. The adjusting units 1 can exert a vertical force on the respective chock so that the upper supporting roll 5 applies a rolling force to the upper working roll 6. The adjusting unit 1 comprises an adjusting piston 2 which divides an adjusting cylinder 17 movably into a first chamber 3 and a second chamber 4. If the first chamber 3 is pressurized with a higher pressure than the second chamber 4, the adjusting piston 2 moves towards the second chamber 4 and the roll gap 19 is reduced. If the second chamber 4 is subjected to a higher pressure than the first chamber 3, the adjusting piston 2 moves towards the first chamber 3 and the roll gap 19 is increased.

The pressurization of the two chambers 3, 4 is controlled by two valve arrangements 9, 10. The first valve arrangement 9 and the second valve arrangement 10 each comprise exactly one valve 11, 12, whereby the valve 12 of the second valve arrangement 10 has a larger nominal volume flow than the valve 11 of the first valve arrangement 9.

Figures 2A, 2B, 2C, 2D:
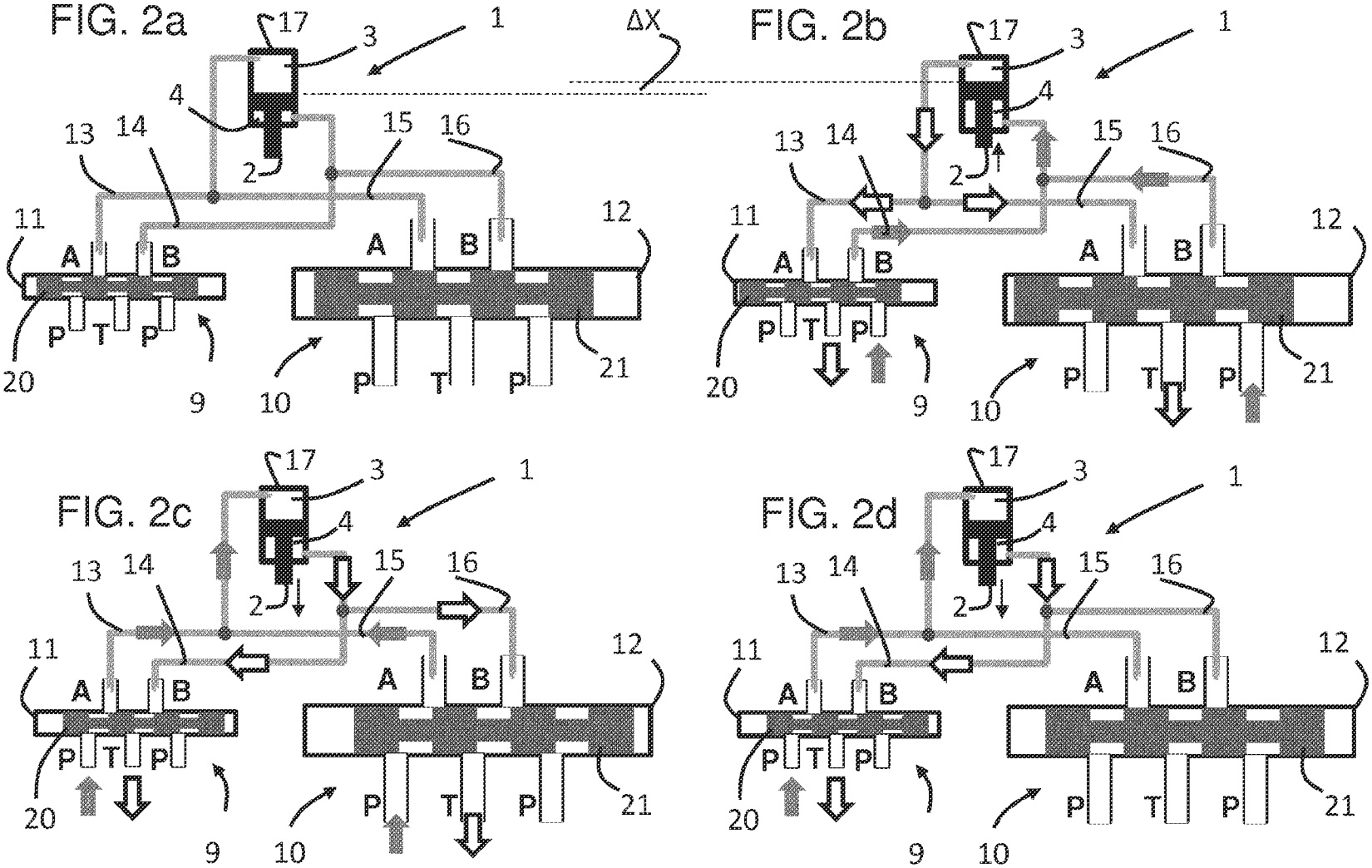
FIG. 2*a* shows a section of the hydraulic arrangement from FIG. 1 in a first switching position of valve arrangements.
FIG. 2*b* shows a section of the hydraulic arrangement from FIG. 1 in a second switching position of the valve arrangements.
FIG. 2*c* shows a section of the hydraulic arrangement from FIG. 1 in a third switching position of the valve arrangements.
FIG. 2*d* shows a section of the hydraulic arrangement from FIG. 1 in a fourth switching position of the valve arrangements.

As can be seen in FIGS. 2*a* to 2*b*, the valve 11 in the first embodiment of the hydraulic arrangement is designed as a 5/3-way valve, which controls a first pressure medium path 13 and a second pressure medium path 14, with a control element 20. The valve 11 is connected with a port A to the first chamber 3 via the first pressure medium path 13 and with a port B to the second chamber 4 via the second pressure medium path 14. In addition, valve 11 is connected with two ports P to a pressure medium source 27 and with a port T to a tank 28, which are only shown in FIG. 1.

Valve 12 of the second valve arrangement 10 is also designed in the first embodiment of the hydraulic arrangement as a 5/3-way valve, which controls a third pressure medium path 15 and a fourth pressure medium path 16, with a control element 21. Valve 12 is connected with a port A to the first chamber 3 via the third pressure medium path 15 and with a port B to the second chamber 4 via the fourth pressure medium path 16. In addition, valve 12 is connected with two ports P to a pressure medium source 27 and with a port T to a tank 28, which are only shown in FIG. 1.

Any arrangement which can provide a substantially constant working pressure greater than 200 bar, in particular greater than 250 bar, in particular greater than 300 bar, at a defined volume flow at ports P of the valve arrangements 9, 10 is conceivable as a pressure medium source 27. Thus, a direct connection of one or more pumps to ports P of valve arrangements 9, 10 is possible or one or more pressure medium reservoirs can be arranged between the valve arrangements 9, 10 and a pump. In the shown embodiment, ports P of valve arrangements 9, 10 are fed from a common pressure medium source. However, it is also conceivable that at least some of the ports P of the valve arrangements 9, 10 are connected to a separate pressure medium source.

Any arrangement is conceivable as tank 28, which enables the hydraulic fluid flowing out of the adjusting unit 1 to be collected and the pumps of the pressure medium source 27 to be supplied with hydraulic fluid. The arrangement can be designed in such a way that the hydraulic fluid flowing out can drain off as quickly as possible. For this purpose, it is conceivable that the outflowing hydraulic fluid could reach an intermediate tank 29, which is positioned near the valve arrangements 9, 10 and in particular has a distance of less than 3 m from the valve arrangements 9, 10, and from there be conveyed to a main tank 28. Pulsation dampers 30 can be arranged in the return line 31 between the valve arrangements 9, 10 and the main tank 28, especially before the intermediate tank 29, to dampen pulsations of the hydraulic fluid flowing out quickly from the valve arrangements 9, 10.

The valve 11 of the first valve arrangement 9 and the valve 12 of the second valve arrangement 10 are shown in FIG. 2*a* in a first switching position in which the first chamber 3 and the second chamber 4 are not pressurized with working pressure from the pressure medium source and the adjusting piston 2 remains in closed position. This is achieved by positioning the control elements 20, 21 each in such a way that the two chambers 3, 4 of the adjusting cylinder 17 are hydraulically isolated from both the pressure medium source and the tank, thus preventing the hydraulic fluid from flowing into and out of one of the two chambers 3, 4. If unintentional leakages between the adjusting cylinder 17 and the adjusting piston 2 respectively at the valve arrangements 9, 10 are neglected, the adjusting piston 2 cannot move either towards the first chamber 3 or towards the second chamber 4 due to the substantial incompressibility of the hydraulic fluid.

FIG. 2*b* shows valve 11 of the first valve arrangement 9 and valve 12 of the second valve arrangement 10 in a second switching position, in which the second chamber 4 is pressurized with the working pressure of the pressure medium source. In this switching position the adjusting piston 2 moves towards the first chamber 3 and the roll gap 19 is increased. This is achieved by positioning the control elements 20, 21 each in such a way that the first chamber 3 of the adjusting cylinder 17 is hydraulically connected to the tank and thus hydraulic fluid can flow from the first chamber 3 to the tank. The outflow of the hydraulic fluid is represented in the figures by white arrows with black borders. In addition, the second chamber 4 of the adjusting cylinder 17 is hydraulically connected to the pressure medium source via valves 11, 12 and the hydraulic fluid is fed into the second chamber 4 at the working pressure. The inflow of the hydraulic fluid is shown in the figures by filled arrows.

FIG. 2*c* shows valve 11 of the first valve arrangement 9 and valve 12 of the second valve arrangement 10 in a third switching position, in which the first chamber 3 is pressurized with the working pressure of the pressure medium source. In this switching position, the adjusting piston 2 moves towards the second chamber 4 and the roll gap is reduced or the roll force is increased. This is achieved by positioning the control elements 20, 21 each in such a way that the second chamber 4 is hydraulically connected to the tank and thus hydraulic fluid can flow from the second chamber 4 to the tank. In addition, the first chamber 3 of the adjusting cylinder 17 is hydraulically connected to the pressure medium source via valves 11, 12, and the hydraulic fluid under the working pressure flows into the first chamber 3.

For a desired displacement of the adjusting piston 2 by the stroke $\Delta X$, as shown between FIGS. 2*a* and 2*b*, a stroke volume corresponding to the product of the effective cross-sectional area of the adjusting cylinder 17 and the stroke $\Delta X$ must be conveyed into the second chamber 4 and simultaneously out of the first chamber 3. It has to be noted that the effective cross-sectional area of the second chamber 4 is annular due to the piston rod and is smaller than the effective cross-sectional area of the first chamber 3. The second valve arrangement 10 has a larger nominal volume flow than the first valve arrangement 9. When valve arrangements 9, 10 are fully open, a larger part of the stroke volume is thus conveyed into the second chamber by the second valve arrangement 10 than by the first valve arrangement. It is therefore possible to divide the stroke $\Delta X$ into a first section, in which the roll position should be changed as quickly as possible, and at least one subsequent second section, in which the nominal position should be approached as accurately as possible. The control of valve arrangements 9, 10 can be designed in such a way that in the first section of the stroke $\Delta X$ both valve arrangements 9, 10 are open to allow the largest possible volume flow, as shown in FIGS. 2*b* and 2*c*. In the second section, the second valve arrangement 10 is closed and the resulting volume flow corresponds to the nominal volume flow of the first valve arrangement 9.

FIG. 2*d* shows valve 11 of the first valve arrangement 9 and valve 12 of the second valve arrangement 10 in a fourth switching position, in which—as previously in FIG. 2*c*—the first chamber 3 is pressurized with the working pressure of the pressure medium source. In this switching position, the adjusting piston 2 moves towards the second chamber 4 and the roll gap is reduced or the roll force is increased. In this fourth switching position, the control element 21 of valve 10 is in a closed position, so that hydraulic fluid flows into the first chamber 3 and hydraulic fluid flows out of the second chamber 4 only via the first valve 9. The resulting volume flow and thus also the actuating speed of adjusting piston 2 is thus reduced compared to the third switching position. This enables a more precise positioning of the adjusting unit respectively the working roll 6.

The valve arrangements 9, 10 are each controlled by a setting variable which is output by a controller 25. The valves 11, 12 are each designed as continuous valves, in particular as servo valves or servo valves with pilot control, so that the two valves 11, 12 can be set continuously between an open position with nominal volume flow and a closed position without volume flow via the setting variable. By varying the opening degrees of valves 11, 12, the resulting volume flow and thus the stroke speed of adjusting piston 2 can be adjusted specifically via the stroke ΔX.

To determine the setting variables, the actual roll position can be fed to controller 25 as a controlled variable and the nominal roll position from a process controller as a reference variable. The nominal roll position can be specified by the process control system depending on a nominal thickness profile. It is also conceivable that the nominal roll position is determined depending on an actual thickness profile of the outgoing strip material 18' recorded by the measuring unit 8 and/or a thickness profile of the incoming strip material 18' recorded by the measuring unit 7.

Figure 3:
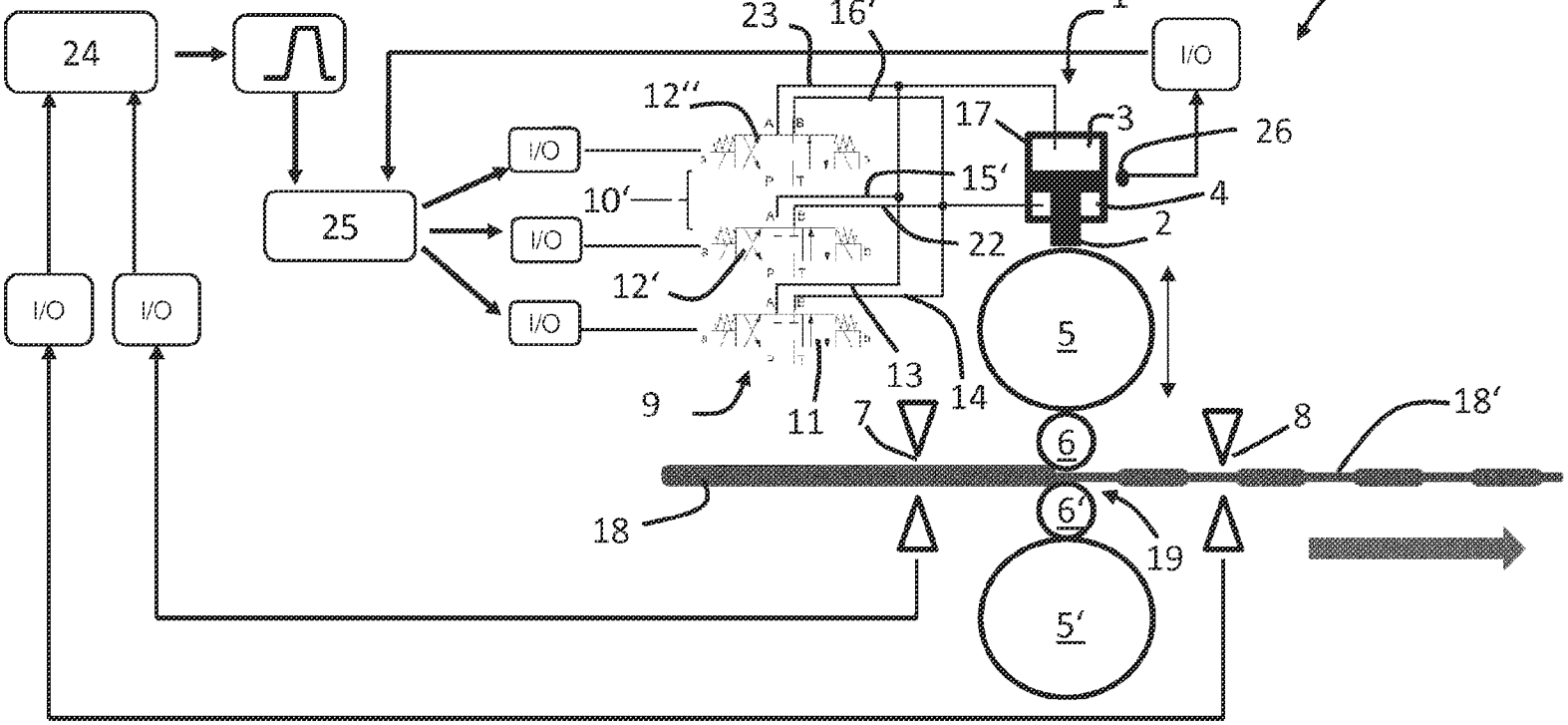
FIG. 3 schematically shows a hydraulic arrangement respectively a roll stand according to the disclosure with a hydraulic arrangement according to a second embodiment.

FIG. 3 schematically shows a hydraulic arrangement and a roll stand with such a hydraulic arrangement according to a second embodiment, which differs from the hydraulic arrangement in FIG. 1 only in the alternative design of the second valve arrangement 10'. Identical elements of the hydraulic arrangements are marked with identical reference numbers. For the similarities, therefore, it is referred to the explanations to FIGS. 1 and 2*a* to 2*d*.

The second valve arrangement 10' according to the second embodiment comprises a first valve 12' and a second valve 12". The first valve 12' controls with a control element 21' the third pressure medium path 15' and an additional fifth pressure medium path 22. For this purpose, the valve 12' is connected with a port A to the first chamber 3 via the third pressure medium path 15' and with a port B to the second chamber 4 via the fifth pressure medium path 22. In addition, the valve 12' is hydraulically connected with a port P to a pressure medium source not shown and with a port T to a tank. The second valve 12" controls the fourth pressure medium path 16' and an additional sixth pressure medium path 23 with a control element 21". The second valve 12" is hydraulically connected with a port B to the second chamber 4 via the fourth pressure medium path 16' and with a port A to the first chamber 3 via the sixth pressure medium path 23. In addition, the valve 12' is hydraulically connected with a port P to a pressure medium source not shown and with a port T to a tank.

The two control elements 21', 21" of the valves 12', 12" are kinematically decoupled, so that the valve 12' and the valve 12" can be adjusted independently of each other by a controller 25. In particular, the two valves 12', 12" are designed identically as 5/3-way valves and have a total nominal volume flow which is greater than the nominal volume flow of the first valve arrangement 9. It is understood that the individual valves can also be designed or controlled differently, for example as valves acting on adjusting unit 1 in one direction only, which together form the double-acting valve arrangement for actuating adjusting unit 1 in both directions. In a further modified embodiment, the first valve arrangement 9 may alternatively or additionally comprise two or more valves, which may be designed analogously to the two valves 12', 12" of the second valve arrangement 10', as described above.

FIGS. 4*a* to 4*d* show the switching positions of the second embodiment analogous to the switching positions of the first embodiment in FIGS. 2*a* to 2*d*, wherein the respective volume flows belonging to the switching positions are additionally realized by the two pressure medium paths 22, 23. Reference should therefore be made at this point to the explanations of FIGS. 2*a* to 2*d*.

Figure 4A:
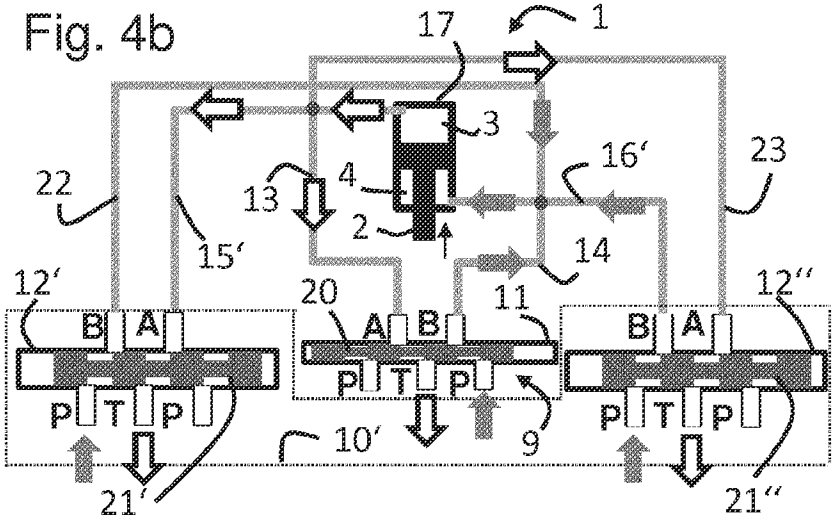
FIG. 4*a* shows a section of the hydraulic arrangement from FIG. 3 in a first switching position of the valve arrangements 9, 10'.
Figure 4B:
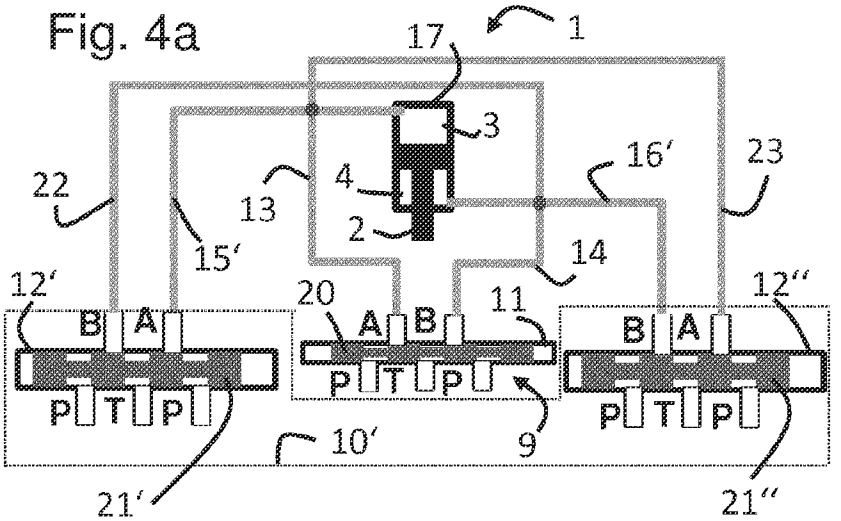
FIG. 4*b* shows a section of the hydraulic arrangement from FIG. 3 in a second switching position of the valve arrangements 9, 10'.
Figure 4C:
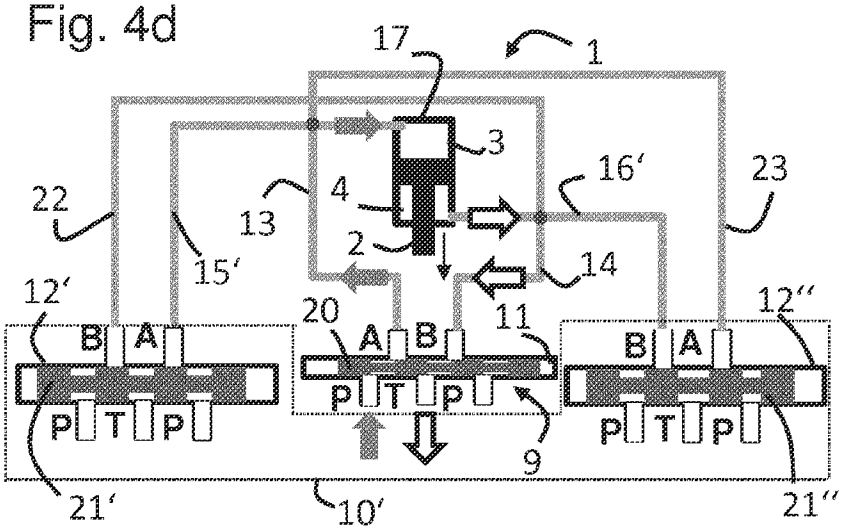
FIG. 4*c* shows a section of the hydraulic arrangement from FIG. 3 in a third switching position of the valve arrangements 9, 10'.
Figure 4D:
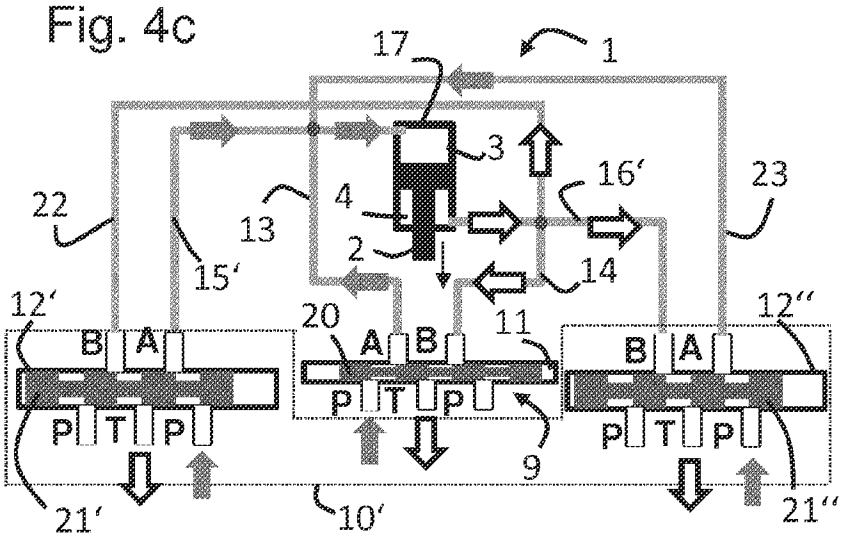
FIG. 4*d* shows a section of the hydraulic arrangement from FIG. 3 in a fourth switching position of the valve arrangements 9, 10'.
Figure 4E:
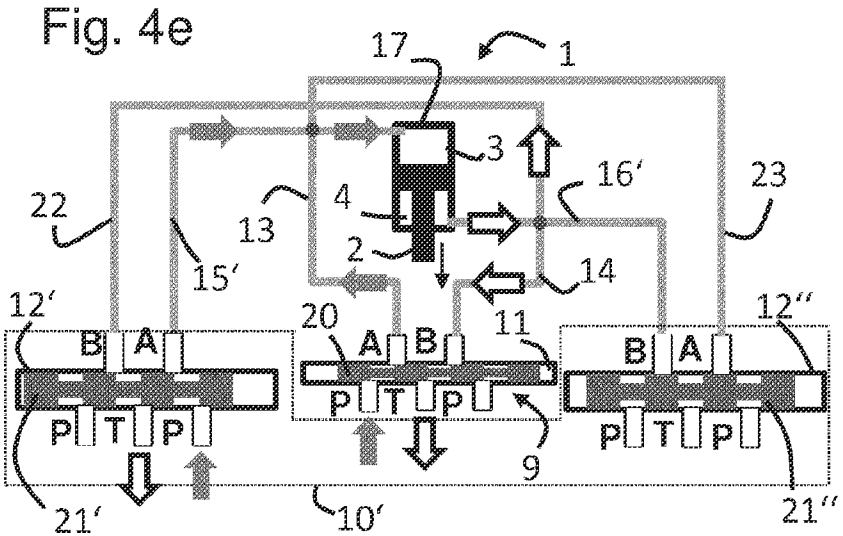
FIG. 4*e* shows a section of the hydraulic arrangement from FIG. 3 in a fifth position of the valve arrangements 9, 10'.

FIG. 4*e* shows an intermediate switching position between the switching positions of FIG. 4*c*, in which a high stroke speed is realized by a maximum volume flow, and the switching position of FIG. 4*d*, in which a low stroke speed is realized by a low volume flow for exact positioning. The second valve 12" of the second valve arrangement 10' is closed, so that a volume flow into the first chamber 3 and out of the second chamber 4 is only realized by the valves 11 and 12'. The resulting volume flow is smaller than the volume flow realized in FIG. 4*c* and larger than the volume flow realized in FIG. 4*d*. It is thus evident that by dividing the second valve arrangement 10' into two valves 12', 12" with kinematically decoupled control elements 21', 21", a higher variability in the control of the adjusting unit is achieved. The second valve arrangement can be represented by any number of valves connected in series and/or in parallel, which together enable double-acting actuation of the adjusting cylinder 17 with a larger nominal volume flow than the nominal volume flow of the first valve arrangement. In particular, 2/2, 3/2, 3/3, 4/2, 4/3 or 5/3-way valves can be used for this purpose. It is understood that the first valve arrangement 9 can also be composed analogously by several valves and thus the variability of the control of the adjusting unit 1 can be further increased.

Figure 5:
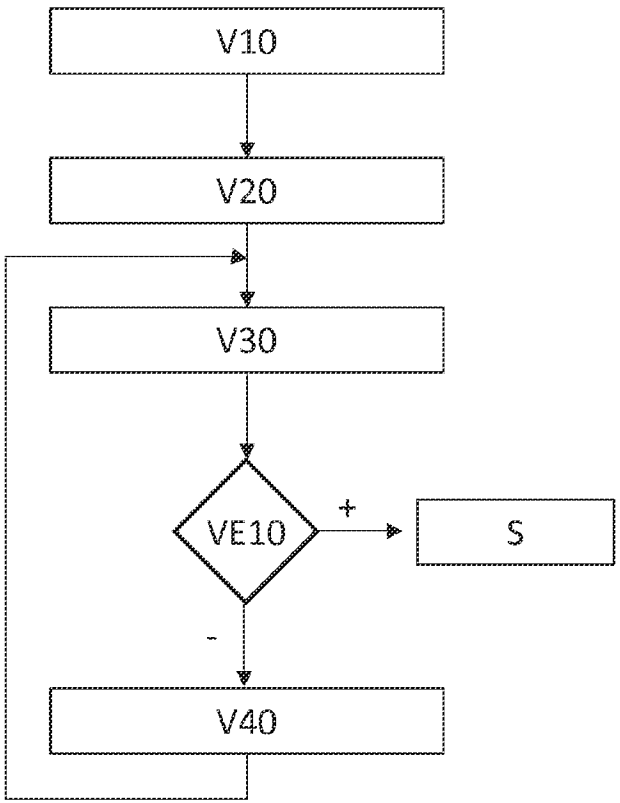
FIG. 5 illustrates a method according to the disclosure for controlling a roll gap of a roll stand in a flow diagram.

FIG. 5 shows a flow diagram showing a method according to the disclosure for controlling a roll gap 19 of a roll stand 32. In a process step V10 a start roll position of a working roll 6 is determined. Subsequently, in a process step V20, a nominal roll position of working roll 6 is determined, so that a stroke ΔX between the start roll position and the nominal roll position can be determined. This can be done by a control unit 24 depending on a nominal thickness profile as well as a thickness measurement 7 on the infeed side of the working roll 6 and a profile thickness measurement 8 on the outfeed side of the working roll. In a process step V30 an actual roll position is measured by a position sensor 26.

In a process decision VE10 it is subsequently checked whether the actual roll position corresponds to the nominal roll position. If the actual roll position matches the nominal roll position, the process is stopped in a process step S and the roll position is maintained. If the actual roll position and the nominal roll position differ from each other, an opening degree of a first valve arrangement 9 and an opening degree of a second valve arrangement 10, 10' is controlled in a process step V40 in order to control an adjusting unit, which is operatively connected to the working roll 6, depending on the actual roll position and the nominal roll position. The second valve arrangement 10, 10' has a larger nominal volume flow than the first valve arrangement 9.

The controlling of the adjusting unit in a first section of a stroke between the actual roll position and the nominal roll position is performed by the second valve arrangement. In this first section, the controlling of the adjusting unit can thus be performed by the second adjusting unit alone or by the second valve arrangement together with the first valve arrangement. Thus, large volume flows can be set, which leads to a high actuating speed of the adjusting unit.

The controlling of the adjusting unit in a second section of the stroke between the actual roll position and the nominal roll position, which includes the nominal roll position, is performed solely by means of the first valve arrangement. Due to the smaller nominal volume flow of the first valve arrangement, the adjusting unit can be positioned more precisely, wherein lower actuating speeds are achieved.

LIST OF REFERENCE NUMBERS

1 adjusting unit
2 adjusting piston
3 first chamber
4 second chamber
5, 5' supporting roll
6, 6' working roller
7 thickness measuring system
8 thickness measuring system
9 first valve arrangement
10, 10' second valve arrangement
11 valve
12, 12', 12" valve
13' first pressure medium path
14 second pressure medium path
15.15' third pressure medium path
16, 16' fourth pressure medium path
17 adjusting cylinder
18, 18' strip material
19 roll gap
20 control element
21, 21', 21" control element
22 fifth pressure medium path
23 sixth pressure medium path
24 control unit
25 controller
26 position sensor
27 pressure medium source
28 main tank
29 intermediate tank
30 pulsation damper
31 return line
32 roll stand
A valve port for first chamber
B valve port for second chamber
P valve port for pressure medium source
T valve port for tank
ΔX stroke

The invention claimed is:

1. A roll stand with at least two working rolls for rolling strip material and with a hydraulic arrangement for controlling a roll gap of the roll stand, comprising:

at least one hydraulic adjusting unit for adjusting the roll gap, the hydraulic adjusting unit comprising a cylinder and an adjusting piston, the adjusting piston dividing the cylinder into a first chamber and a second chamber;

a first valve arrangement for variably controlling the adjusting unit;

a second valve arrangement for variably controlling the adjusting unit, which is arranged in parallel to the first valve arrangement; wherein the first valve arrangement has a smaller nominal volume flow than the second valve arrangement;

wherein the first valve arrangement is hydraulically connected to the first chamber and the second chamber for double-acting actuation of the adjusting unit such that the piston can be both extended and retracted by the first valve arrangement, wherein the second valve arrangement is hydraulically connected to the first chamber and the second chamber for double-acting actuation of the adjusting unit such that the piston can be both extended and retracted by the first valve arrangement, wherein the hydraulic adjusting unit is controllable such that a first stroke section of a stroke of the cylinder is implemented by both the first valve arrangement and the second valve arrangement, and a second stroke section of the stroke of the cylinder is implemented only by the first valve arrangement that has a smaller nominal volume flow than the second valve arrangement, and wherein the hydraulic adjusting unit is capable of being subjected to a working pressure greater than 200 bar from a pressure medium source.

2. The roll stand of claim 1, wherein at least one of the first valve arrangement and the second valve arrangement comprises at least one continuous valve for controlling the hydraulic adjusting unit.

3. The roll stand of claim 1, wherein the hydraulic adjusting unit can be pressurized by a working pressure greater than 250 bar, wherein the pressure medium source comprises a pump or a pressure medium reservoir with a connected pump.

4. The roll stand of claim 1, wherein the second valve arrangement has a nominal volume flow which is greater than twice the nominal volume flow of the first valve arrangement.

5. The roll stand of claim 1, wherein a main tank is provided which is hydraulically connected to the first valve arrangement and the second valve arrangement, and at least one intermediate tank is arranged between the main tank and at least one of the first valve arrangement and the second valve arrangement, wherein the intermediate tank is arranged at a distance of less than three meters from at least one of the first valve arrangement and the second valve arrangement.

6. The roll stand of claim 5, wherein the intermediate tank is arranged in a return line between at least one of the first valve arrangement and the second valve arrangement, and the main tank.

7. Roll stand according claim 1, wherein the adjusting unit comprises exactly one adjusting piston, so that only two chambers are formed in the cylinder; whereby the only two chambers are the first chamber and the second chamber.

8. The roll stand of claim 1, wherein the first valve arrangement controls a volume flow of a first pressure medium path, which is connected to the first chamber, and a volume flow of a second pressure medium path, which is connected to the second chamber.

9. The roll stand of claim 1, wherein the second valve arrangement controls a volume flow of a third pressure medium path, which is connected to the first chamber, and a volume flow of a fourth pressure medium path, which is connected to the second chamber.

10. The roll stand of claim 1, wherein a pulsation damper is arranged in a return line between at least one of the first valve arrangement and the second valve arrangement, and the main tank.

11. A method for controlling a roll gap of a roll stand with the roll stand comprising at least two working rolls for rolling strip material, a hydraulic arrangement for controlling the roll gap, at least one hydraulic adjusting unit for adjusting the roll gap, the hydraulic adjusting unit comprising a cylinder and an adjusting piston, the adjusting piston dividing the cylinder into a first chamber and a second chamber, a first valve arrangement for variably controlling the adjusting unit, a second valve arrangement for variably controlling the adjusting unit, which is arranged parallel to the first valve arrangement, wherein the first valve arrangement has a smaller nominal volume flow than the second valve arrangement, wherein the first valve arrangement is hydraulically connected to the first chamber and the second chamber for double-acting actuation of the adjusting unit, wherein the second valve arrangement is hydraulically connected to the first chamber and the second chamber for double-acting actuation of the adjusting unit, and wherein the hydraulic adjusting unit is capable of being subjected to a working pressure greater than 200 bar from a pressure medium source;

the method comprising:

determining an actual roll position of a working roll of the at least two working rolls;

determining a nominal roll position of the working roll; and controlling an opening degree of the first valve arrangement and an opening degree of the second valve arrangement depending on the actual roll position and the nominal roll position, wherein the roll gap is changed during rolling, wherein for at least one thickness change of a thickness profile to be rolled, the adjusting unit is controlled in a first section of a stroke of the cylinder between the actual roll position and the nominal roll position by the first valve arrangement and the second valve arrangement, and in a second section of the stroke of the cylinder only by the first valve arrangement that has a smaller nominal volume flow than the second valve arrangement.

12. The method of claim 11, wherein, for roll gap changes of more than 10% of the roll gap value, the adjusting unit is controlled in the first section of the stroke by the first valve arrangement and the second valve arrangement.

13. The method of claim 11, wherein at least one setting variable for controlling the opening degree of the first valve arrangement and at least one setting variable for controlling the opening degree of the second valve arrangement are output with a time offset.

14. The method of claim 11, wherein, in order to control the opening degree of the first valve arrangement, a first setting variable for a first valve of the first valve arrangement and a second setting variable for a second valve of the first valve arrangement are output with a time offset, and for controlling the opening degree of the second valve arrangement, a first setting variable for a first valve of the second valve arrangement and a second setting variable for a second valve of the second valve arrangement are output with a time offset.

15. The method of claim 11, wherein the nominal roll position is determined depending on a nominal thickness profile and at least one of a thickness measurement on an inlet side of the working roll and a profile thickness measurement on an outlet side of the working roll.

* * * * *